United States Patent [19]

Yang

[11] Patent Number: 4,519,229

[45] Date of Patent: May 28, 1985

[54] COMBINATION LOCK

[76] Inventor: Yaw-Kuen Yang, No. 190-30, Chang-Shui Rd., Tzu-Tung Li, Chang Hua City, Taiwan

[21] Appl. No.: 468,111

[22] Filed: Feb. 22, 1983

[51] Int. Cl.[3] ..... E05B 37/12

[52] U.S. Cl. ..... 70/312; 70/316

[58] Field of Search ..... 70/312, 315–318, 70/67, 69, 71, 292, 293, 287, 288

[56] References Cited

U.S. PATENT DOCUMENTS

| | | | |
|---|---|---|---|
| 3,851,507 | 12/1974 | Gehrie . | |
| 4,123,923 | 11/1978 | Bako | 70/316 X |
| 4,155,234 | 5/1979 | Bako | 70/316 X |
| 4,198,837 | 4/1980 | Gisiger | 70/316 X |
| 4,343,163 | 8/1982 | Scelba et al. | 70/71 X |
| 4,385,509 | 5/1983 | Milles et al. | 70/312 X |

FOREIGN PATENT DOCUMENTS

| | | | |
|---|---|---|---|
| 1469564 | 1/1967 | France | 70/288 |
| 2030208 | 4/1980 | United Kingdom | 70/312 |
| 2100783 | 1/1983 | United Kingdom | 70/69 |

*Primary Examiner*—Gary L. Smith
*Assistant Examiner*—Thomas J. Dubnicka
*Attorney, Agent, or Firm*—McDermott, Will & Emery

[57] ABSTRACT

A combination lock includes a bolt plate that can be retracted independently of a fence plate and dial wheel assemblies when a strap hinge is pressed thereagainst so that the bolt plate can latch into the strap hinge whether the dial wheel assemblies are in a proper combination symbols or not. The bolt plate which latches into the strap hinge can be moved against a biasing force by means of a fence plate which has spaced apart downward hook members abutted against three dial wheel assemblies when it is locked against a releasing movement. Each of the dial wheel assemblies are provided with a radial bore and an axial groove, the radial bores being respectively registered with the axial grooves when the dial wheels are in the proper combination of symbols in a proper sequence for permitting the releasing movement of the fence plate that brings the bolt plate to an unlatching position.

9 Claims, 8 Drawing Figures

COMBINATION LOCK

BACKGROUND OF THE INVENTION

This invention relates to a combination lock, particularly to an improved and novel combination lock.

The prior art relates to combination locks of the type including, a bolt plate which is guided by a fence plate manually operated through an axternal knob, and dial wheel assemblies which are set to a proper combination of symbol in a proper sequence for opening the lock.

SUMMARY OF THE INVENTION

An object of the invention is to provide a novel and improved combination lock the construction of which is so simplified that the component parts thereof can be easily processed.

Another object of the invention is to provide a combination lock having a bolt plate that can be in a retracted position without restraint of the fence plate or dial wheel assemblies so that the strap hinge can be latched by the bolt plate whether the dial wheel assemblies are in a proper combination of symbol or not, thereby facilitating the locking operation of the lock.

According to the present invention, a combination lock comprises; a casing; dial wheel assemblies provided side by side in the front portion of the casing and biassed upward to be exposed in part for manual operation, each of the dial wheel assemblies including an outer dial wheel, an axle member for mounting, and a collar member sleeved onto the axle member and separably engaged with the inner side of the dial wheel; a bolt plate provided in the rear of the dial wheel assemblies and having an upwardly bent end; means for biassing the bolt plate in the longitudinal direction to a latching position in contact with the bent end of the bolt plate; a fence plate provided over the bolt plate and movable parallelly relative to the longitudinal axis of the bolt plate, the fence plate having a first contact surface bearing against another side of the bent end of the bolt plate, the fence plate being externally operated for movement to bring the bolt plate to a release position, and further including second contact surfaces bearing against the peripheral surfaces of the collar members so that it is locked against the movement in the direction opposite to the direction of the biassing means, the movement of the fence plate being permitted only when the dial wheel assemblies are turned to a proper combination of symbols.

According to an aspect of the invention, the casing is formed of a base housing and a top cover plate, the base housing being provided with recesses for respectively receiving the dial wheel assemblies and the bolt plate. The fence plate is held in position by the supports of the bolt plate and the collar members.

According to another aspect of the invention, each collar member is slidable relative to each axle members and has a radial bore. Each axle member is provided with an axial groove. When the dial wheels are turned to a proper combination of symbols, the radial bores are respectively registered with the axial grooves, thereby enabling the hook members to enter in the respective axial grooves from the peripheral surfaces in the direction opposite to the direction of the biassing means.

According to further aspect of the invention, the fence plate is further provided with a flange member, projected downwardly from the longitudinal edge thereof, from which the hook members extended. The collar members are further provided with respective annular grooves for receiving and guiding the flange member.

These and other objects, features and advantages of the present invention will be more apparent in the following description of a preferred embodiment with reference to the accompanying drawings, in which:

DETAILED DESCRIPTION OF THE PREFERRED EMBODIMENT

Figure 1:
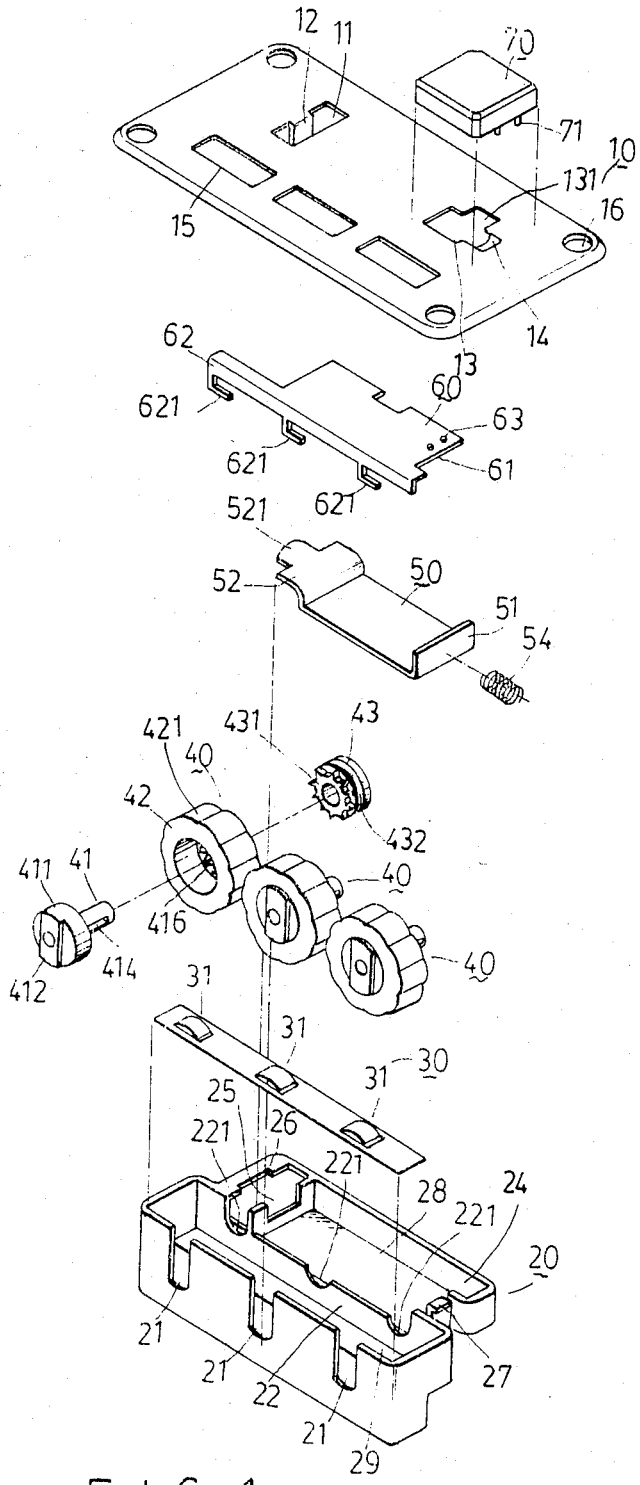
FIG. 1 is an exploded view of a combination lock constructed according to the invention.
Figure 3:
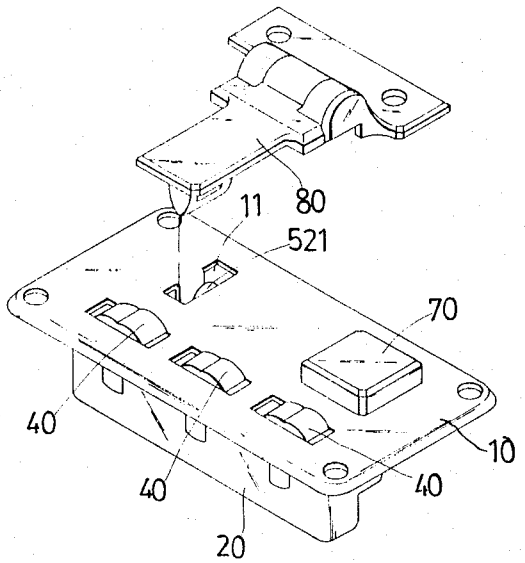
FIG. 3 is a perspective view of the combination lock with a strap hinge.
Figure 4:
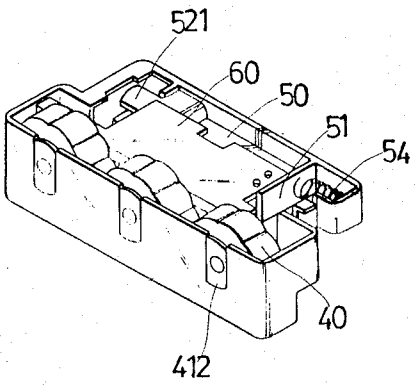
FIG. 4 is a perspective view showing portions of the combination lock.
Figure 2:
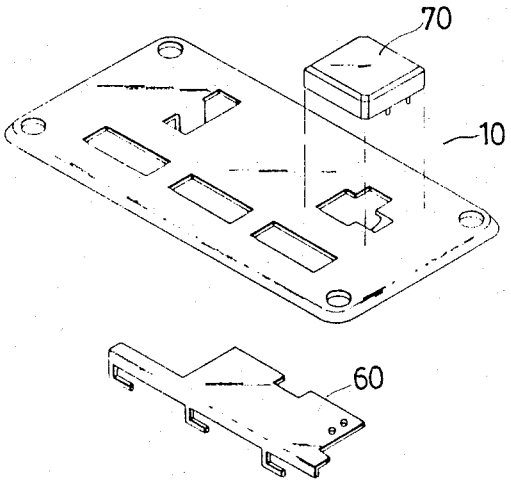
FIG. 2 is another exploded view of the combination lock.
Figure 2:
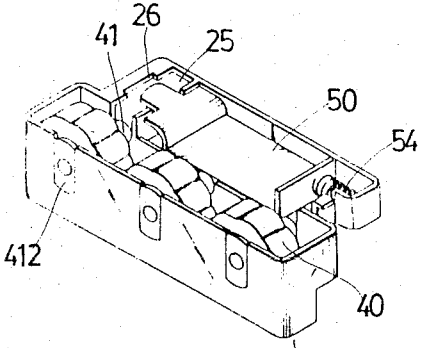
Figure 7:
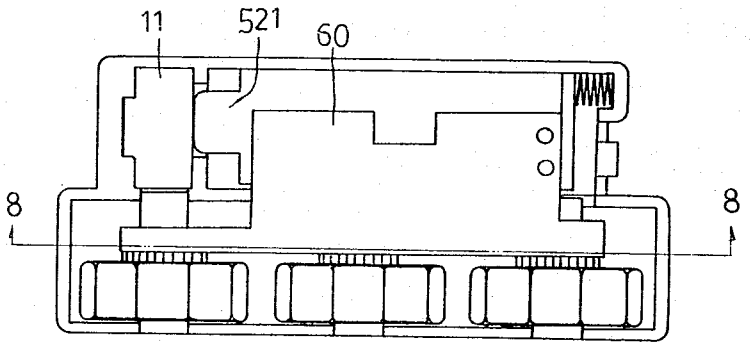
FIG. 7 is a plan view of FIG. 4 showing the position in which the collar members are separated from the dial wheels for re-setting a new combination of symbols.

Now referring to the drawings, there is shown a combination lock which includes a casing formed of a top cover plate 10 and a base housing 20. The cover plate 10 is provided with a strap hole 11, a lug 12 in the strap hole 11, a knob hole 13 having a notch formation 131, a raised part 14, three rectangular dial wheel holes 15, and four mounting holes 16 for attachment of fasteners.

The base casing 20 includes three U-shaped journal openings 21 in the frontal wall thereof, recesses 29, 28, 25 and a projection 27. When the top cover plate 10 is attached to the base housing 20, the projection 27 is engaged in the raised part 14 and the lug 12 of the cover plate 10 is in abutment with the dented surface 26 of a wall bounding the recess 25.

Figure 6:
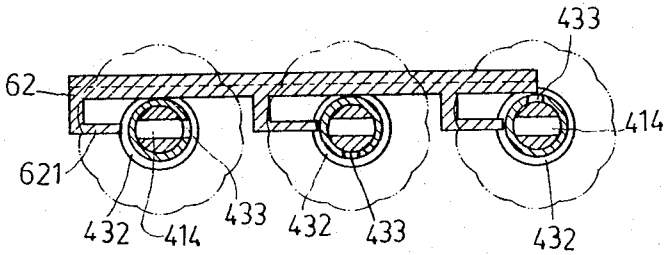
FIG. 6 is a fragmentary sectioned view taken along the line 6—6 of FIG. 5.

There is further provided a spring plate 30 which has three spring portions 31 and is provided in the recess 29. On the spring portions 31 are provided three dial wheel assemblies 40 which are biassed to be exposed through the holes 15 so that they can be manually dialled. Each dial wheel assembly 40 is comprised of an axle member 41 which has a larger diameter body 411 having a diametric cross projection 412 for engagement with U-shaped openings 21. A longitudinal groove 414 is provided in each axle member 41 and the end of each axle 41 is rested in each recess 221 of a support member 22. Each dial wheel 40 assembly further has a collar member 43 and an outer dial wheel 42 the periphery 421 of which is provided with a number of numerals (not shown). The collar member 43 is slidable relative to the axle member 41 and separably engaged with the inner side of the dial wheel 42 by means of gear teeth 416 and 431. There is further provided an annular groove 432 at the medial portion of each collar 43 and a radial bore 433 in each groove 432 as better seen in FIGS. 6 and 8.

There is further provided a bolt plate 50 in the recess 28 of the housing 20. The bolt plate 50 has an upwardly bent end 51 and a stepped front portion 52 which has a latching end 521 projecting into the recess 25. This bolt plate 50 is normally biassed to a latching position by a spring coil 54 which is received in a narrow recess 24 and in contact with the bent end 51. The bolt plate 50 is longitudinally and limitedly movable in the recess 28.

Over the bolt plate 50 is a fence plate 60 which has a straight contact surface 61 parallel to and bearing against the surface of the upwardly bent end 51. The fence plate 60 further has a downwardly projected flange portions 62 and spaced apart L-shaped hooks 621 downwardly extending from the portion 62. It is held in a horizontal position by the horizontal flat surface of the stepped portion 52 of the bolt plate 50 and the collars 43. The downwardly projected flange portions 62 is received in and guided by the annular grooves 432 of the collars 43 and the L-shaped hooks 621 are arranged near the sides of the collars 43. There is further provided a rectangular knob 70 which has two pins 71 to be fitted in two pin holes 63 of the fence plate 60 through the knob hole 13 of the cover plate 10 for operating the fence plate 60.

Figure 8:
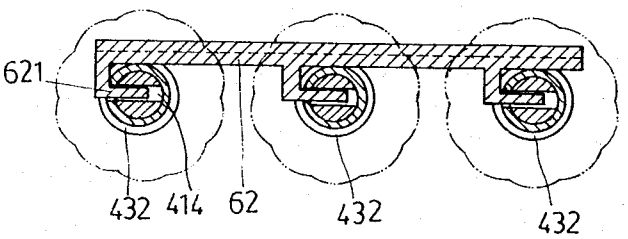
FIG. 8 is a fragmentary sectioned view taken along the line 8—8 of FIG. 7.
Figure 5:
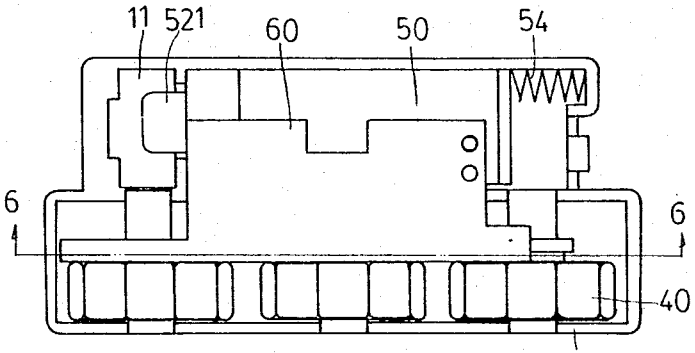
FIG. 5 is a plan view of FIG. 4 showing the locking position of the lock.

In the locking position, the latching end 521 of the bolt plate 50 is engaged with the strap hinge 80 by the biassing force of the spring coil 54. The end surfaces of the hooks 621 bear against the surfaces of the annular grooves 432 of the collars 43 so that the fence plate 60 is locked against the movement in the direction opposite to the direction of the biassing force of the spring coil 54, as better shown in FIG. 6. When the dial wheels 42 are dialed to a proper combination of symbols in a proper sequence, the radial bores 433 of the collars 43 are in registration with the axial grooves 414 of the axle members 41 as shown in FIG. 8. At this position, the hooks 621 which bear against the annular grooves 432 enter into the axial grooves 414 through the radial bores 433 of the collars 43, thereby permitting the movement of the fence plate 60 opposite to the direction of the biassing spring coil 54. Consequently, when the fence plate 60 is moved against the force of the spring coil 54 by means of the manually operated knob 70, it will carry the bolt plate 50 to an unlatching position, i.e. a retracted position.

When it is wanted to set a new combination of symbols for opening the lock, it is necessary to operate the knob 70 to put the lock in an unlatching or open position and then move against the knob 70 in such a manner that the pins 71 come into the notch 131 of the knob hole 13. Accordingly, the hooks 621 which are engaged with the radial bores 433 of the collars and axial grooves 414 and the flange 62 which are engaged in the annular grooves 432 are moved axially relative to the axle member 41, thereby causing the collars 43 to disengage from the dial wheels 42. At this position, the dial wheels 42 can be turned to a new desired combination of symbols. Thereafter, the collars 43 are moved again to engage with the dial wheels 42 by operating through the knob 70. As the axle members 41 are stationary and the radial bores 433 do not change the positions, the axial grooves 414 and the radial bores 433 are still in registration after the dial wheels 42 are set to a new combination of symbols.

It can be noted that the bolt plate 50 can be moved against the spring coil 54 without restriction by the fence plate 60 and the dial wheel assemblies 40. Therefore, the strap hinge 80 can be pressed in the strap hole 11 of the cover plate 10, i.e. the latching end 521 of the bolt plate 50 can latch into the strap hinge 80, whether the dial wheels 42 are in the proper combination of symbols or not, thereby facilitating the locking operation of the combination lock 1.

With the invention thus explained, it is apparent that obvious modifications and variations can be made without departing from the scope of the invention. It is therefore intended that the invention be limited only as indicated in the appended claims.

What I claimed is:

1. A combination lock comprising:

a casing;

dial wheel assemblies provided side by side in the front portion of said casing and biased upward to be exposed in part for manual operation; each of said dial wheel assemblies including an outer dial wheel, an axle member for mounting, and a collar member slidably sleeved onto said axle member and separably fitted to said dial wheel, said axle member of a first said wheel assembly being mounted in said casing separate from and parallel to said axle member of a second wheel assembly; each said axle member having an axial groove and each of said collar members having a radial bore, said radial bores being respectively registered with said axial grooves when said dial wheels are turned to a proper combination;

a bolt plate provided in the rear of said dial wheel assemblies and having an upwardly bent end;

means for biasing said bolt plate in the longitudinal direction to a latching position in contact with one side of said bent end;

a fence plate which is externally operated for movement to bring said bolt plate to a release position, provided longitudinally over said bolt plate and movable parallel relative to the longitudinal axis of said bolt plate, said fence plate having a first contact surface bearing against another side of said bent end, and having second contact surfaces bearing directly against the peripheral surfaces of said collar members so that it is locked against the movement in the direction opposite to the direction of said biasing means, said movement being permitted only when said dial wheel assemblies are turned to a proper combination of symbols.

2. A combination lock as claimed in claim 1, wherein said fence plate includes hook members spaced apart and extended downward from the longitudinal edge of said fence plate, said hook members having end surfaces to bear against the peripheral surfaces of said collar members.

3. A combination lock as claimed in claim 2, wherein each of said dial wheel assemblies has gear teeth members respectively provided at the inner side of said dial wheel and on said collar member.

4. A combination lock as claimed in claim 3, wherein each of said axle members has an axial groove and each of said collars has a radial bore, said radial bores being respectively registered with said axial grooves when said dial wheels are turned to a proper combination of symbols, thereby enabling said hook members to respectively enter in said axial grooves which permit the movement opposite to the force of said biassing means.

5. A combination lock as claimed in claim 4, wherein said fence plate further includes a flange member, projected downwardly from the longitudinal edge thereof, from which said hook members extended.

6. A combination lock as claimed in claim 5, wherein each of said collar members further includes an annular groove for receiving and guiding said flange member, said radial bore being located in said annular groove.

7. A combination lock as claimed in claim 6, wherein said casing has a first recess in which said bolt plate can be limitedly moved.

8. A combination lock as claimed in claim 7, wherein said casing further has a second recess for receiving said dial wheel assemblies.

9. A combination lock as claimed in claim 8, wherein said bolt plate has a raised flat portion opposite to said bent end, and said fence plate is held in position by said raised flat portion and by said collar members.

* * * * *